US006593286B1

(12) United States Patent
Kenney et al.

(10) Patent No.: US 6,593,286 B1
(45) Date of Patent: Jul. 15, 2003

(54) CONSUMER PRODUCT COMPOSITIONS COMPRISING PHOTOSENSITIVE MATERIALS AS PHOTOBLEACHES OR PHOTODISINFECTANTS

(75) Inventors: Malcolm Edward Kenney, Cleveland Heights, OH (US); Ying-Syi Li, Highland Heights, OH (US); Rafael Ortiz, Milford, OH (US); David Johnathan Kitko, Cincinnati, OH (US); Michael Eugene Burns, Hamilton, OH (US)

(73) Assignee: Case Western Reserve University, Cleveland, OH (US)

( * ) Notice: Subject to any disclaimer, the term of this patent is extended or adjusted under 35 U.S.C. 154(b) by 0 days.

(21) Appl. No.: 09/936,066

(22) PCT Filed: Mar. 1, 2000

(86) PCT No.: PCT/US00/05410

§ 371 (c)(1),
(2), (4) Date: Jan. 23, 2002

(87) PCT Pub. No.: WO00/52123

PCT Pub. Date: Sep. 8, 2000

Related U.S. Application Data

(60) Provisional application No. 60/122,931, filed on Mar. 5, 1999.

(51) Int. Cl.[7] ..... C11D 7/26; C11D 7/32; C11D 7/54

(52) U.S. Cl. ..... 510/394; 510/311; 510/376; 510/370; 510/499; 510/506; 510/324; 510/325; 510/326; 540/122; 540/123; 540/128

(58) Field of Search ..... 510/311, 376, 510/370, 499, 394, 506, 324, 325, 326; 540/122, 123, 128; 8/137

(56) References Cited

U.S. PATENT DOCUMENTS 5,166,197 A * 11/1992 Kenney et al. ..... 514/63
5,484,778 A * 1/1996 Kenney et al. ..... 514/63
5,817,614 A * 10/1998 Miracle et al. ..... 510/376
5,916,481 A * 6/1999 Willey ..... 252/186.21

FOREIGN PATENT DOCUMENTS

WO WO 98/32826 * 7/1998

* cited by examiner

*Primary Examiner*—Gregory Delcotto
(74) *Attorney, Agent, or Firm*—Fay, Sharpe, Fagan, Minnich & McKee, LLP

(57) ABSTRACT

Consumer product compositions such as laundry detergents comprising selected photosensitive compounds for photobleaching, photodisinfection, antibacterial activity, hueing or other benefits. The compositions are preferably formulated with detersive surfactants and/or water-soluble polymers.

8 Claims, No Drawings

CONSUMER PRODUCT COMPOSITIONS COMPRISING PHOTOSENSITIVE MATERIALS AS PHOTOBLEACHES OR PHOTODISINFECTANTS

This application claims priority under 35 USC 119(e) to U.S. provisional application No. 60/122,931, filed Mar. 5, 1999.

FIELD OF THE INVENTION

The present invention is in the field of conumer products comprising photobleaches and photodisinfectants, epecially metal or metalloid phthalocyanine compounds useful for treating fabrics, e.g., in consumer products such as laundry detergents.

BACKGROUND OF THE INVENTION

Historically, photobleaches in consumer products have been ionic, usually as a result of sulfonation. Salt forms of simple Zn or Al phthalocyanines are typically used. Sulfonation improves water-solubility and decreases interaction with common anionic surfactants used in detergents, but increases melting-point of the photobieach relative to a non-charged or non-salt material. Making a photobleach hydrophilic and giving it anionic charge also reduces its ability to partition into, and, upon exposure to light, to bleach oily, soils and stains.

Recently, certain non-charged (nonionic) photobleaches have been developed. These include sophisticated ligands and non-charged photobleaches among those disclosed in WO 98/32832 A, WO 98/32829 A, WO 98/32828 A, WO 98/32827 A, WO 98/32826 A, WO 98/32825 A, and WO 98/32824 A all published Jul. 30, 1998; and WO 97/05203 A and WO 97/05202 published Feb. 13, 1997. These materials can be quite hydrophobic and are useful in laundry detergents. They have an improved ability to treat oily soils.

Other photobleaches used in detergents have included some so-called "ion pair" types.

Despite the recent advances, there remains a need for further improvements in photobleaches and/or photodisinfectants for use in consumer products. Specifically, there is an ongoing need for consumer products comprising photobleaches and/or photodisinfectants which are more resistant to aggregation, more useful for treating synthetic or lipid-soiled fabrics, and are readily capable of being uniformly dispersed, e.g., on dilution, in a consumer product composition. Uniform dispersion is very important to avoid a patchy effect in photobleaching of fabrics, or for effective photodisinfectancy.

It is accordingly an object of the present invention to provide further improvements in consumer product compositions comprising photobleach and/or photodisinfectant compounds.

These and other objects are accomplished herein, as will be seen from the following disclosure.

BACKGROUND ART

See for example U.S. Pat. Nos. 5,872,248; 5,484,778; 5,763,602; Derwent 93-032275; EP-284,370 A; EP-296,876; EP-366,440; EP-484,027 A; EP 538,228 A; EP-596,184; GB 2,260,996; GB 2,279,657; GB 2,313,122; JP 3285998 (See Derwent 92-038692); JP 51/39044; JP 52/55339; JP 60/48047; JP 61/57536; JP 7292398 A (see Derwent 96-017535); KR 97-61275; KR 9102515 (see Derwent 92-321309); U.S. Pat. Nos. 3,860,484; 4,166,718; 4,209,417; 4,304,719; 4,368,053; 4,800,188; 4,806,514; 4,911,919; 5,135,717; 5,280,183; 5,346,670; 5,437,929; 5,482,514; 5,484,778; 5,561,106; 5,585,483; 5,665,689; 5,665,875; 5,679,661; 5,733,560; 5,824,800; WO 91/18006; WO 91/18007; WO 92/01753; WO 92/01753; WO 94/22960; WO 95/06688; WO 95/24267; WO 95/31526; WO 96/29367; WO 97/05202; WO 97/05202; WO 97/05203; WO 97/10811; WO 98/14521; WO 98/25455; WO 98/32827; WO 98/32832; and WO 98/44052.

See also U.S. Pat. No. 3,094,536, Jun. 18, 1963; U.S. Pat. No. 3,927,967, Dec. 23, 1975; U.S. Pat. No. 4,033,718, Jul. 5, 1977; U.S. Pat. No. 4,240,920, Dec. 23, 1980; U.S. Pat. No. 4,255,273, Mar. 10, 1981; U.S. Pat. No. 4,256,597, Mar. 17, 1981; U.S. Pat. No. 4,318,883, Mar. 9, 1982; U.S. Pat. No. 4,497,741, Feb. 5, 1985; U.S. Pat. No. 4,648,992, Mar. 10, 1987; and U.K. Pat. Appl. 1,372,035 published Oct. 30, 1974; U.K Pat. Appl. 1,408,144 published Oct. 1, 1975; U.K. Pat App. 2,159,516 published Dec. 4, 1985; E.P. 285,965 A2; E.P. 381,211 A2 published Aug. 8, 1990; E.P. 484,027 Al published May 6, 1992; and Japanese Kokai 06-73397 Derwent Abst. No. (94-128933) published Mar. 15, 1994.

In addition to the above, other references describe the synthesis, preparation and properties of phthalocyanines and naphthalocyanines; see *Phthalocyanines: Properties and Applications,* Leznoff, C. C. and Lever A. B. P. (Eds), VCH, 1989; *Infrared Absorbing Dyes,* Matsuoka, M. (Ed), Plenum, 1990; *Inorg. Chem.,* Lowery, M. J. et al., 4, pg. 128, (1965); *Inorg. Chem.* Joyner R. D. et al., 1, pg. 236, (1962); *Inorg. Chem.,* Kroenke, W. E. et al., 3, 696, 1964; *Inorg. Chem.* Esposito, J. N. et al., 5, pg.1979, (1966); *J. Am. Chem. Soc.* Wheeler, B. L. et al., 106, pg. 7404, (1984); *Inorg. Chem.* Ford, W. E, et al., 31, pg. 3371, (1992); *Material Science,* Witkiewicz, Z. et al., 11, pg. 39, (1978); *J. Chem. Soc.* Perkin Trans. I, Cook, M. J., et al., pg. 2453, (1988); *J. Chin. Chem. Soc.,* 40, pg. 141, (1993); *J. Inorg. Nucl. Chem.,* 28, pg. 899, (1966); *Polymer Preps,* 25, pg. 234, (1986); *Chem. Lett.,* 2137, (1990); *J. Med. Chem.,* 37, pg. 415, (1994).

SUMMARY OF THE INVENTION

In one embodiment, the present invention provides an improvement in a composition for consumer product application comprising at least one adjunct (which can vary widely, e.g., detergent adjuncts, softeners, water-purifiers, dry-cleaning adjuncts) and a nonionic photobleach or photodisinfectant compound (the terms photobleach and photodisinfectant being used interchangable except where specifically noted) wherein the nonionic photobleach compound comprises: (A) a metal or metalloid selected from Ga. Ge, Sn, Si and Al; (B) a chromophore selected from substituted phthalocyanine, unsubstituted phthalocyanine, substituted naphthalocyanine and unsubstituted naphthalocyanine; and (C) one or two bonded ligands, occupying axial positions. The improvement comprises at least one of said ligands (the axially bonded ligands) having the formula:

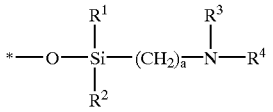

wherein $R^1$ and $R^2$ are $C_1$–$C_4$ alkyl moieties, preferably methyl; a is a number from 2 to 16, more preferably 2 to 6, preferably 3; and $R^3$ and $R^4$ are moieties that can vary independently and are selected from the group consisting of: H, $C_1$–$C_{18}$ alkyl, alkaryl (e.g., benzyl) and a moiety $-(CH_2)_b-X$ wherein b is a number from 2 to 16, more preferably 2 to 6, preferably 2; and X is a hetero-atom containing moiety, preferably an aminofunctional moiety selected from the group consisting of:

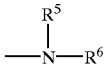

wherein $R^5$ and $R^6$ can vary independently and are selected from the group consisting of: H, $C_1$–$C_{18}$ alkyl, and alkaryl (e.g., benzyl); and * marks the bond to said metal or metalloid.

Stated alternatively, the invention includes a composition for consumer product application comprising at least one adjunct (preferably at least about 0.0001% of said adjunct wherein said adjunct is unsuitable for photodynamic therapy or other purposes in internal medicine) and at least about 0.001 ppm, preferably 0.015 ppm to about 0.5% of a nonionic photobleach compound characterized by:

(A) a metal or metalloid selected from Ga, Ge, Sn, Si and Al; (B) a chromophore selected from substituted phthalocyanine, unsubstituted phthalocyanine, substituted phthalocyanine and unsubstituted naphthalocyanine; and (C) one or two bonded ligands, occupying axial positions; wherein said ligands (the aforementioned bonded ligands) comprise at least one ligand having the formula:

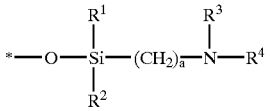

wherein $R^1$ and $R^2$ are $C_1$–$C_4$ alkyl moieties, preferably methyl; a is a number from 2 to 16, more preferably 2 to 6, preferably 3; and $R^3$ and $R^4$ are moieties that can vary independently and are selected from the group consisting of: H, $C_1$–$C_{18}$ alkyl, alkaryl (e.g., benzyl) and a moiety $-(CH_2)_b-X$ wherein b is a number from 2 to 16, more preferably 2 to 6, preferably 2; and X is a hetero-atom containing moiety, preferably an aminofunctional moiety selected from the group consisting of:

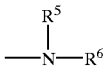

wherein $R^5$ and $R^6$ can vary independently and are selected from the group consisting of: H, $C_1$–$C_8$ alkyl, and alkaryl (e.g., benzyl); and * marks the bond to said metal or metalloid.

In a preferred embodiment, the invention encompasses a composition as generally described above wherein said chromophore is selected from the group consisting of unsubstituted phthalocyanine, phthalocyanine substituted by from 1 to 8 $C_1$–$C_8$ alkyl or alkaryl substituents, unsubstituted naphthalocyanine and naphthalocyanine substituted by from 1 to 8 $C_1$–$C_8$ alkyl or alkaryl substituents and said ligand has a formula selected from the group consisting of:

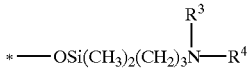

wherein $R^3$ and $R^4$ are selected from the group consisting of H and methyl and $-(CH_2)_2N(CH_3)_2$. An example of such ligand is:

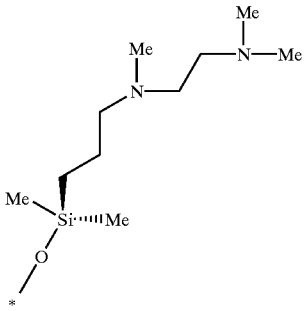

The present compositions constitute useful consumer products, as will be seen from the following disclosure.

The invention has many other ramifications and embodiments, and numerous advantages, as will also be seen from the disclosure. All percentages and proportions herein are by weight unless otherwise indicated. The units of parts per million or "ppm" wherein 1 ppm=1 milligram per liter 0.0001% by weight may alternatively be used herein from time to time, especially for content of photobleach compound in a composition of the invention.

All documents cited herein are incorporated by reference in their entirety.

DETAILED DESCRIPTION OF THE INVENTION

Preferred Embodiments

Further preferred herein is the composition as generally described above wherein said metal or metalloid is selected from the group consisting of Si and Al, and said chromophore is selected from the group consisting of unsubstituted phthalocyanine and phthalocyanine substituted by from 1 to 8 teri-butyl substituents; and, more preferably, those wherein said metal or metalloid is Si(IV). Highly preferred nonionic photobleach compounds herein include those comprising two ligands of said formula, although when only a single selected ligand is present, any conventional moiety, e.g., —OH or —Cl, if needed, can complete coordination about the metalloid.

While photobleach compounds having no substituents of the chromophore are acceptable, one preferred group of nonionic photobleach compounds herein has said chromophore selected from the group consisting of phthalocyanine or naphthaiocyanine, preferably phthalocyanine, wherein said chromophore is substituted by from 1 to 8, preferably from 1 to 4, tert-butyl substituents and wherein said substituents are preferentially attached to carbon atoms of the phthalocyanine or naphthalocyanine which are maximally remote from the metalloid.

Such substitution is better understood by reference to the following formulae (I) and (II) which represent the general chromophore structures of the present preferred Si(IV) phthalocyanine (I) and naphtalocyanine (II) compounds in detail:

(I)

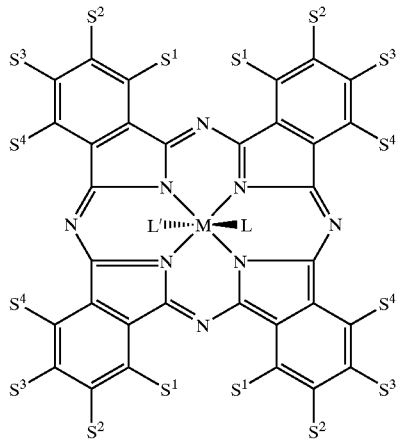

(II)

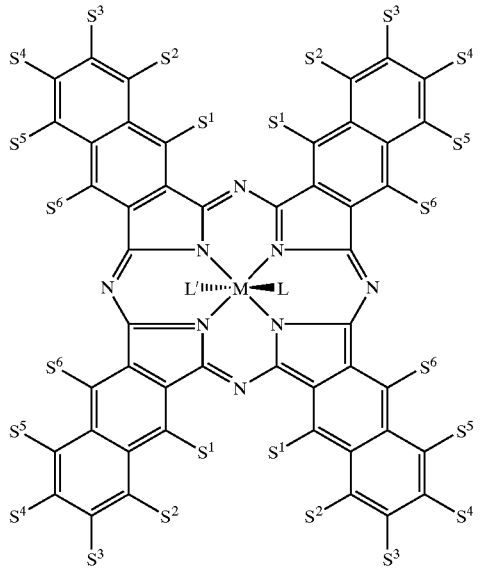

In formula (I), substituents $S^2$ and $S^3$ are those which are "maximally remote" from the metalloid, M. Thus when any of the substituents S are different from H, it is preferred for the substituents $S^2$ and $S^3$ to be the non-hydrogen substituents, preferably tert-butyl. In formula (I), M is preferably Si(IV) and ligands L and L' are preferably selected from the group consisting of:

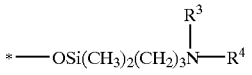

wherein $R^3$ and $R^4$ are selected from the group consisting of H and methyl and $—(CH_2)_2N(CH_3)_2$. An example of such ligand is:

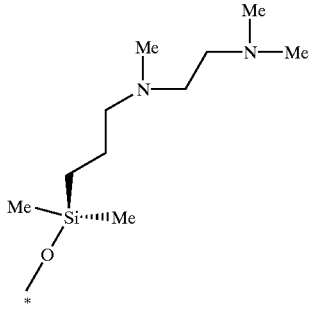

The invention includes consumer product compositions, such as dry-cleaning additives, pretreaters, laundry detergents, fabric softeners, or the like, comprising at least about 0.001 ppm of any of said nonionic photobleach compounds. Such consumer product compositions can in general include, for example, detergent compositions for laundering fabrics, dry-cleaning compositions or wash-baths, laundry additive compositions, fabric softeners, water disinfection compositions, and the like. Preferred consumer product compositions include those comprising the nonionic photobleach compound and at least about 0.001% of a consumer product adjunct material. The adjunct material can in general be selected from those commonly used in the various types of consumer product. Preferred consumer products include a laundry detergent combining the photobleach and an adjunct material which comprises from about 0.1% to about 50% by weight of the composition of a detersive surfactant.

The present invention further includes a method of cleaning a dingy fabric comprising a step of treating the dingy fabric with a consumer product composition comprising any of the photobleach compounds (especially the hydrophobic nonionic types) herein. In preferred methods, said consumer product composition is a member selected from the group consisting of: (i) laundry or dry-cleaning pre-treaters; (ii) laundry detergents; (iii) fabric softeners; and (iv) aerosol or spray-based fabric treatments other than (i)–(iii).

The invention further relates to a process for providing intermediate compositions of formulated photobleaches for use in consumer products, or for improving ease of formation thereof, said process comprising the steps of: (a) providing a photobleach compound as defined herein (especially those which are hydrophobic nonionic types); and (b) mixing said photobleach compound with one or more adjuncts, thereby forming an intimate mixture of said photobleach in said adjunct or adjuncts. Preferred adjuncts for such a process include certain water-soluble polymers.

More generally, the invention includes a consumer product composition providing photobleaching and/or photodisinfectancy and/or antibacterial benefits, comprising at least about 0.001 ppm of a photosensitive compound of the formula HOSi(Pc)L as photobleach or photodisinfectant, wherein Pc is a substituted or non-substituted phthalocyanine and L is an aminosiloxy ligand, wherein said photosensitive compound is the product of a process comprising: (a) providing a phthalocyanine precursor having a central silicon; (b) adding two aminosiloxy ligands to the central silicon of the phthalocyanine precursor; (c) displacing one of the aminosiloxy ligands by an organic acid ligand; (d) then displacing the organic acid ligand with an hydroxyl; to provide said photosensitive compound. Such a process is disclosed in detail in U.S. Pat. No. 5,763,602, incorporated by reference in its entirety.

Moreover the invention encompasses a consumer product composition comprising, as photobleach and/or photodisinfectant and/or as antibeterial agent: (a) at least about 0.001 ppm, preferably 0.015 ppm to about 0.5% of a phthalocyanine compound having the formula MPc wherein Pc is a substituted or non-substituted phthalocyanine and M is $$(G)_a Y[(OSi(CH_3)_2(CH_2)_b N_c(R')_d(R'')_e)_f X_g]_p$$

wherein: Y is selected from the group consisting of Si, Al, Al, Ga, Ge and Sn; R' is selected from the group consisting of H, $CH_2$, $CH_3$, $C_2H_5$, $C_4H_9$, $C_4H_8NH$, $C_4H_8NCH_3$, $C_4H_8S$, $C_4H_8O$, $C_4H_8Se$, $CH_2CH_3$, $(CH_2)_3(CH_3)$, $OC(O)CH_3$, CS, CO, CSe, OH, $C_4H_8N(CH_2)_3CH_3$, $(CH_2)_3N(CH_3)_2$, $C(O)C_{27}H_{30}N_2O$, $(CH_2)_nN(CH_2)_0(CH_3))_2$ and an alkyl group having from 1 to 12 carbon atoms; R" is selected from the group consisting of H, $SO_2CH_3$, $(CH_2)_2N(CH_3)_2$, $(CH_2)_{11}CH_3$, $C(S)NHC_6H_{11}O_5$, $(CH_2)_nN((CH_2)_0(CH_3)_2$ and an alkyl group having from 1 to 12 carbon atoms; G is selected from the group consisting of OH, $CH_3$ and $(CH_3)_3C(CH_3)_2SiO$; X is selected from the group consisting of anions, e.g., I; F; Cl, Br and the anions of anionic detersive surfactants; a=0 where Y is Al, or 1 where Y is Si; b=an integer from 2 to 12; c=0 or 1; d=0,1,2 or 3; e=0,1, or 2; f=1 or 2; g=0 or 1; n=an integer from 1 to 12; o=an integer from 1 to 11; and p=1 or 2; (b) at least about 0.001%, preferably from about 0.01% to about 25% of a polymeric delivery vehicle; (c) at least about 0.01%, preferably from about 0.1% to about 95% of a detersive surfactant; and (d) at least about 0.0001%, preferably from 0.01% to about 99% of a nonsurfactant detergent adjunct. The phthalocyanine compounds of this embodiment are fully disclosed in U.S. Pat. No. 5,484,778, incorporated herein by reference in its entirety. One group of said compositions which is preferred for certain applications excludes those wherein M is $AlOSi(CH_3)_2N(CH_2)_3N(CH_3)_2$; $AlOSi(CH_3)_2(CH_2)_3N(CH_3)_3{}^+I^-$; $CH_3SiOSi(CH_3)_2(CH_2)_3N(CH_3)_2$; $HOSiOSi(CH_3)_2(CH_2)_3N(CH_3)_2$; $HOSiOSi(CH_3)_2(CH_2)_3N(CH_3)_3{}^+I^-$; $Si[OSi(CH_3)_2(CH_2)_3N(CH_3)_3{}^+I^-]_2$; or $Si[OSi(CH_3)_2(CH_2)_3N(CH_3)_2]_2$. A preferred group of such compositions is one wherein $M=Si[OSi(CH_3)_2(CH_2)_4NH_2]_2$; $Si[OSi(CH_3)_2(CH_2)_4NHSO_2CH_3]_2$; $HOSiOSi(CH_3)_2(CH_2)_4NHSO_2CH_3$; $HOSiOSi(CH_3)_2(CH_2)_3N(CH_2CH_3)(CH_2)_2N(CH_3)_2$; $Si[OSi(CH_3)_2(CH_2)_4NHCSNHC_6H_{11}O_5]_2$; $HOSiOSi(CH_3)_2(CH_2)_3OCOCH_3$; $Si[OSi(CH_3)_2(CH_2)_3N^+(CH_3)_2(CH_2)_{11}CH_3]_2X^-$ wherein $X^-$ is an anion, e.g. $F^-$, $Cl^-$, $Br^-$, $I^-$ or the anion of an anionic detersive surfactant; $(CH_3)_3C(CH_3)_2SiOSiOSi(CH_3)_2(CH_2)_4NCOC_{27}H_{30}N_2O$; $HOSiOSi(CH_3)_2(CH_2)_3OH$; $Si[OSi(CH_3)_2(CH_2)_3N(CH_2CH_3)(CH_2)_2N(CH_3)_2$; $HOSiOSi(CH_3)_2(CH_2)_3NC_4H_8O$; $AlOSi(CH_3)_2(CH_2)_3N^+(CH_3)_2(CH_2)_{11}CH_3X^-$ wherein $X^-$ is an anion, e.g., $F^-$, $Cl^-$, $Br^-$, $I^-$ or the anion of an anionic detersive surfactant; $HOSiOSi(CH_3)_2(CH_2)_8N(CH_3)_2$; $Si[OSi(CH_3)_2(CH_2)_8NC_4H_8O]_2$; $HOSiOSi(CH_3)_2(CH_2)_3NC_4H_8S$; $HOSiOSi(CH_3)_2(CH_2)_3N((CH_2)_3CH_3)_2$; $HOSiOSi(CH_3)_2(CH_2)_3NCS$; $HOSiOSi(CH_3)_2(CH_2)_3N[(CH_2)_3N(CH_3)_2]_2$; $HOSiOSi(CH_3)_2(CH_2)_3NC_4H_8NCH_3$; $Si[OSi(CH_3)_2(CH_2)_3NC_4H_8NCH_3]_2$; $HOSiOSi(CH_3)_2(CH_2)_3NC_4H_8N(CH_2)_3CH_3$; $Si[OSi(CH_3)_2(CH_2)_3NC_4H_8NH]_2$; or $Si[OSi(CH_3)_2(CH_2)_3N(CH_3)_2]_2$. All such compounds are disclosed in the aforementioned U.S. Pat. No. 5,484,778 with the exception that '778 does not contemplate the simple exchange of anions by, metathetical reaction, with the anions of anionic detersive surfactants which are common in consumer products.

The above-described consumer product compositions include those preferred composition wherein said polymeric delivery vehicle is selected from polyethylene glycol, e.g., PEG having molecular weight from about 500 to about 10,000, and polyvinylpyrrolidone, e.g., PVP having molecular weight from about 500 to about 10,000. Moreover, the preferred compositions of this type are preferably those wherein said phthalocyanine compound and said polymeric delivery vehicle are mixed prior to addition of said detersive surfactant, (d).

Photobleach Compounds

As formulated in consumer products, in addition to the adjuncts required for making or delivering the full benefit of such compositions, the present invention requires that the inventive compositions comprise an effective amount of a particularly defined and selected photobleach compound.

One group of preferred photobleach compounds have no charged moieties, i.e., they are "nonionic", and they are preferably metal or metalloid phthalocyanines or naphthalocyanines comprising one or two chemically bound ligands occupying axial positions.

This group of compositions thus comprise a hydrophobic photobleach compound as an essential component. The term "hydrophobic" is used in conjunction with this group of preferred photobleaches to distinguish them from "hydrophilic" photobleaches which generally comprise at least one anionically charged group, such as a sulfonate group, which confers water-solubility.

The preferred nonionic photobleaches herein are generally hydrophobic to the extent that when placed in a two-phase mixture of water and common organic solvents such as methylene dichloride, they will preferentially and strongly partition into the organic phase, not the water phase. Such hydrophobic photobleach compounds herein are non-charged, or "nonionic".

All highly preferred hydrophobic nonionic photobleach compounds herein are sufficiently hydrophobic to partition at least partially from a phase which is more hydrophilic than triolein, into triolein.

Chromopbore

Photobleaches or photodisinfectants herein generally comprise a chromophore in the form of a planar or distorted-planar extended cyclic system acting as a polydentate ligand occupying equatorial positions with respect to a metal or metalloid. Together, the chromophore, the metal or metalloid and one or two additional ligands occupying axial positions form a photoactive compound. Preferred chromophores include unsubstituted phthalocyanine and naphthalocyanine (preferably phthalocyanine). Optionally, in general, substituents may be attached to the cyanine. In one group of compositions wherein there is a preference for hydrophobicity, such substituents are not added to when by their addition the photobleach is rendered substantially soluble in water. In embodiments wherein hydrophobicity is preferred, substituents, if present, are noncharged; sulfonate substituents are excluded from all such preferred embodiments.

The invention further includes improvements in consumer product compositions comprising photobleaches wherein the phthalocyanine or naphthalocyanine is substituted. In these photobleaches, there is present at least one hydrocarbon substituent covalently attached to said chromophore. In general, the chromophore substituent can very widely, and includes for example H and hydrocarbon substituents comprising from about three to about 24 carbon atoms. Preferred hydrocarbon substituents are lower alkyl substituents, and include methyl, ethyl, n-propyl, iso-propyl, n-butyl, iso-butyl, tert-butyl and the like.

Metal or Metalloid

Photobleaches herein generally comprise a metal or metalloid selected from the group consisting of Si, Al, Ga, Ge and Sn, more preferably Si and Al, more preferably still, Si. The metal or metalloid, shown as "M" in the following structures, is bound to both to the chromophore and to ligands occupying axial positions, marked X or X' in these structures.

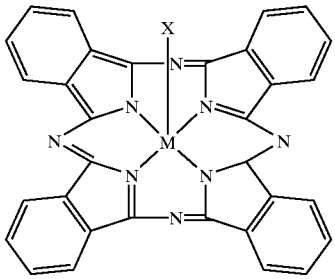

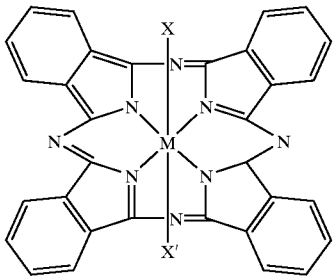

In highly preferred detergent compositions of the invention, the photobleach compound is selected from the group consisting of:

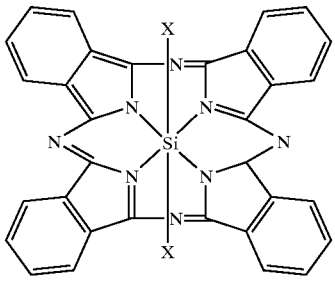

,

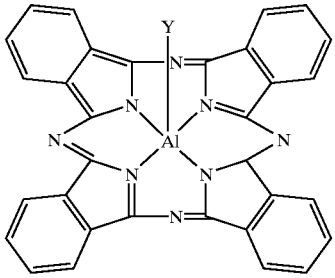

and mixtures thereof wherein X and Y can vary independently and represent axially bonded ligands.

A highly preferred ligand herein has the formula:

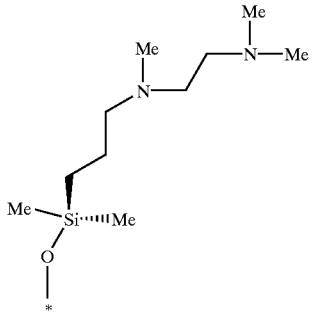

wherein "*" marks the point of attachment to the metal or metalloid of the photobleach.

Photobleach Precursor

Photobleaches herein are commonly prepared from a precursor compound. A common precursor is the dihydroxy Si(IV) phthalocyanine of formula:

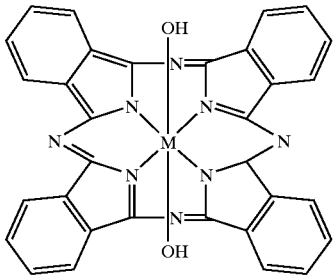

However, in general, any known method for preparing photobleaches can be used herein. Such methods include those of U.S. Pat. Nos. 5,763,602 and 5,872,248, incorporated by reference.

"Ligand", Axial Position, Axial Site Available, "Axial Ligand", "Bonded Ligand"

The term "ligand" herein most generally refers to an organic compound other than phthalocyanine or naphthalocyanine (thus specifically excluding inorganic moieties such as water, —OH, —Cl etc. as in the precursor compound above). The ligand is an organic compound capable of binding axially to a Si, Al, Ga, Ge or Sn (preferably Si(IV)) phthalocyanine moiety. The invention does not exclude Si(IV) phthalocyanines comprising one organic axial ligand and one —OH, but preferably, when the metalloid is Si, the photobleach will have two non-OH organic ligands.

The terms "bonded ligand" or "axial ligand" or "ligand in axial position" herein are used to distinguish ligand which is actually chemically bonded to the metal or metalloid, from any other ligand, e.g., which is simply present in physical admixture with the metal or metalloid compound.

The term "axial" as in "axial position", or "axial ligand", is used herein to indicate a position of bonding with respect to a metal or metalloid. Specifically, in the case of phthalocyanine compounds for example, the phthalocyanine chromophore occupies "equatorial positions" while all non-phthalocyanine ligands occupy "axial positions". In Si(IV) phthalocyanines there are two axial positions, whereas in Al phthalocyanines, there is only one. Thus, a "bonded axial ligand" is by definition a ligand which is not the chromophore, bonded to the metal or metalloid.

On bonding to the photobleach precursor, a ligand molecule may lose a small portion of its mass, for example due to elimination of water or a silanol on reaction with a hydroxyfinctional photobleach precursor. For example when the molecule eliminated is water, the bonded ligand has a molecular weight of 1 less than that of the free or nonbonded ligand.

Photobleach Hue

The photobleaches herein can have any visible hue consistent with the chromophore. Hue preference of laundered fabrics tends to vary from one country or region to another, and can include blue, green or pink hues.

Consumer Product or Detergent Compositions

The present invention encompasses consumer product compositions, including pre-treaters such as stain-sticks or aerosol sprays free from detergent surfactants, as well as laundry detergents for laundering soiled garments or fabrics in dry-cleaning appliances, automatic washing machines or by hand, and photodisinfectant compositions, for example for adding to water. A "detergent composition" is a composition having any suitable form, such as granules, powders, tablets, liquids, gels, pastes or the like, and comprising an effective amount of at least one detersive surfactant capable of removing soils from soiled clothing and an effective amount of least one non-surfactant detergent adjunct. Other forms of consumer product composition forming part of the invention do not require the detersive surfactant, but generally require at least one adjunct of the type not generally permissible for use in photodynamic therapy applications of photosensitive compounds. Such adjuncts can include perfumes, antistatic agents, water filtration agents, and the like.

Effective Amounts of Components

An "effective amount" of a consumer product ingredient or adjunct is an amount capable of at least partially improving the appearance thereof by removal, chemical modification, or physical altering of soil.

An "effective amount" of a photobleach compound is any amount of a photobleach compound or photodisinfectant compound or photosensitive antibacterial compound capable of sanitizing or improving the appearance of a substrate, e.g., a fabric through any photophysical mechanism, be it catalytic or stoichiometric. The improvement may happen on storage, on normal use, in dry-cleaning, washing or laundering stages, or in subsequent stages, such as line drying in the sun. That is, a delayed effect as well as immediate effect are both generally acceptable for efficacy.

Typical "effective amounts" of photobleaches or photodisinfectants can be very low, e.g., parts per billion, more typically a few parts per million up to about 10,000 ppm in a consumer product composition.

"Effective amounts" with respect to detersive surfactants are amounts consistent with exceeding the critical micelle concentration of a single detersive surfactant under the conditions of use, or, when multiple detersive surfactants are used, the in-use concentration of the combination of detersive surfactants is sufficient for forming micelles.

Levels of Photobleach Compound in Consumer Product Compositions

In general, the photobleach or photodisinfectant compounds herein can be used at any level providing a benefit, which can be a photobleaching benefit, a photodisinfectancy benefit, an antibacterial benefit, a hueing benefit, or the like. However, low levels are preferred to avoid staining or overhueing. Suitable levels include from about 0.015 ppm to about 0.5%, more preferably from about 0.010% to about 0.050%, more preferably still from about 0.001% to about 0.01% of hydrophobic photobleach compound in a consumer product composition.

Adjuncts

Any adjuncts other than the photobleach compound or detersive surfactant can be useful herein, provided that at least one adjunct will preferably be one unsuitable for use in internal medicine. That is to say, the present compositions are not suitable for use in photodynamic therapy. It is not intended to exclude compositions wherein a pharmaceutically acceptable material is present, simply to make clear that the present compositions, by their nature and normal composition, are consumer product compositions, and are not photodynamic therapy compositions. A "non-surfactant detergent adjunct" is any component suitable for incorporation in a consumer product, e.g., a laundry detergent, provided that this component is other than a detersive surfactant or a photobleach. Such a component can include, for example, solvents, propellants, polymeric carriers or vehicles, builders, chelants, bleach systems, soil release polymers, softeners, perfumes and the like.

Preferred non-surfactant detergent adjuncts include bleach systems, (especially those comprising hydrophobic bleach activators such as nonanoyloxybenzene sulfonate and/or transition metal bleach catalysts such as Mn or Fe complexes of rigid macrocyclic donors and/or organic bleach boosters), enzyme systems (including both bleaching and non-bleaching enzymes), builders (including sodium tripolyphosphate as well as nonphosphate detergency builders), silicone/silica compounded antifoams, end-capped terephthalate-based soil release polymers, optical brighteners, and pro-perfumes.

In addition to adjuncts provided for directly consumer-useful purposes, the present photobleach compounds can be formulated with other optional components, for example external coatings and/or cationic additives, processing aids or the like.

Detersive Surfactants

A "detersive surfactant" is an amphiphilic compound, typically at least partially water-soluble, preferably completely water-soluble, having at least one hydrophobic moiety, called a "tail", typically comprising a linear or branched hydrocarbyl moiety comprising at least six carbon atoms, and at least one hydrophilic moiety, called a "head-group". The head-group may be charged or non-charged. Common detersive surfactants include anionic, cationic, nonionic and zwitterionic types, extensively recited in patents of detergent formulators and other publications.

When the compositions of the invention are detergent compositions, they comprise, in addition to the photobleach compound, a detersive surfactant, suitably at levels of from about 0.1% to about 99.9%, more preferably from about 0.5% to about 50%, typically from about 1% to about 30% by weight of the detergent composition. In general, the detersive surfactant can be selected from the common commercial detersive surfactants sold for laundry detergent use, including especially anionic detersive surfactants, particularly alkylbenzene sulfonates, alkyl sulfates, methyl ester sulfonates, or mixtures thereof, and nonionic detersive surfactants, particularly alkyl alkoxylates, sugar-derived nonionic surfactants such as APG's or glucosamides, or mixtures thereof. Mixtures of anionic and nonionic detersive surfactants at ratios of from about 1:10 to about 10:1 by weight can be especially useful. Any suitable chainlength or carbon content of the hydrophobe of these surfactants can be used, for example from about $C_8$ to about $C_{20}$, more typically from about $C_8$ to about $C_{17}$. Any degree or type of branching in the hydrophobe is acceptable. The alkylbenzene sulfonates are often used at lower carbon content, for example an average of about $C_{10}$ to $C_{12}$. When the surfactant is anionic, most commonly it is used in the sodium salt form, though other forms, for example potassium, can be used for known reasons such as to promote solubility. Any specialty surfactants, for example foam boosters, can be added if desired.

Polymeric Delivery Vehicles

The present photobleach compounds can, if desired, be formulated with a polymer as a delivery vehicle, for example to protect a photobleach herein, especially the hydrophobic types, from detersive surfactants or other adjuncts, or to help improve total amount or uniformity of deposition. Preferred polymeric delivery vehicles include thermoplastic polymers which soften or melt under conditions of use, e.g., those which are liquid or molten at temperatures less than about 95° C., and water-soluble polymers. Which polymer delivery system to use, and how hydrophobic it should be, are highly dependent on the precise type of consumer product. For example, in laundry detergents, polyalkylene glycols and/or mixed polyalkylene glycols, such as polyethylene glycols, having average molecular weights of from about 150 to about 20,000, preferably between about 600 and about 10,000, more preferably still from about 3,000 to about 6,000, e.g., about 4,000 are very useful. Another group of water-soluble polymers are water-soluble polymers which include N as an amide, including, especially, water-soluble polymers comprising as monomeric units vinylamides such as N-vinylpyrrolidone and N-vinylacetamide as well as vinyl heterocycles such as N-vinylimidazole, N-vinyloxazolidone, N-vinyltriazole, 4-vinylpyridine, and 4-vinylpyridine-N-oxide; or poly-(N-isopropyl acrylamide). Most preferred water-soluble polymer compounds in this group in accordance with this invention are polyvinylimidazole (PVI), or a copolymer of polyvinylpyrrolidone and polyvinylimidazole (PVPVI), most preferably polyvinylpyrrolidone (PVP). Preferably, these highly preferred amidofunctional water-soluble polymers have an average molecular weight of from 20,000 to 60,000. Also suitable herein as polymeric delivery vehicles are mixtures of two or more of any of the foregoing water-soluble polymers. Levels of such polymers in compositions herein can vary widely, but include, when present, at least about 0.001% to about 99.99%, more preferably from about 0.01% to about 25%, more preferably and typically from about 0.05% to about 0.5% of polymer.

Optional Components—Coatings

The present compositions can moreover include variants which comprise an external coating or other encapsulation means for the photobleach compound.

For example, when formulating the photobleach in an aqueous liquid detergent composition, it may be desirable to further coat or protect particles comprising the photobleach with a coating or hardening material such as a microcrystalline wax. Such coating or protection can help ensure better integrity of the photobleach delivery system particles on storage in the liquid detergent composition. Of course, such coatings can be used also when the photobleach delivery system is intended to be incorporated in granules, powders, pastes or tablet forms of the detergent composition.

Levels of such coatings in compositions herein can vary widely, but include, when present, at least about 0.001% to about 99.99%, more preferably from about 0.01% to about 25%, more preferably and typically from about 0.05% to about 0.5% of coating or encapsulating material.

Optional Components to be Formulated with Photobleach Compound

The present photobleaches can be coformulated with any adjunct materials other than cleaning actives. This includes cationic polymers such as cationic starches, polyethyleneimine polymers or copolymers, quaternary ammonium salts of the type used in fabric conditioners or through-the-wash softeners, or the like. Such cationic additives may further improve deposition of the photobleach on fabrics in certain detergent compositions, especially those wherein the detersive surfactant component is to a large extent nonionic rather than anionic.

Levels of optional components in compositions herein can vary widely, but include, when present, at least about 0.001% to about 90%, more preferably from about 0.01% to about 25%, more preferably and typically from about 0.05% to about 0.5% of the optional component or adjunct.

Any other optional component consistent with the spirit and scope of the invention may be added to the photobleach, provided that it does not result in a consumer product composition which provides no photobleaching.

Non-Surfactant Detergent Adjunct

Detergent compositions herein suitably comprise at least one nonsurfactant detergent adjunct. Preferably said nonsurfactant detergent adjunct comprises one or more members selected from the group consisting of: bleaching enzymes; non-bleaching enzymes; transition metal bleach catalysts; organic bleach boosters; bleach activators; oxygen bleach sources; preformed peracids; soil release agents; builders; chelants; conventional water-soluble sulfonated photobleaches; and mixtures of any of these adjuncts. Suitable levels of nonsurfactant detergent adjuncts in the inventive compositions can vary widely. For example, in detergent compositions of the invention, the composition suitably comprises from about 0.0001% to about 99%, more preferably from about 1% to about 90%, typically from about 20% to about 85% by weight of the detergent composition of at least one non-surfactant detergent adjunct.

Form of Detergent Compositions

When the compositions of the invention are detergent compositions, the compositions can have any suitable form, for example granules, tablets, pouches, syndet bars, gels, pastes or the like. Other suitable forms include heavy-duty liquid laundry detergents, substantially nonaqueous laundry detergents in liquid or solid form, and aqueous forms of any of said detergents. When the composition of the invention is other than a detergent, it can likewise take any form. For example, a formulated photodisinfectant composition comprising the photobleaches herein can take the form of a sachet or tablet. One such photodisinfectant tablet comprises the photobleach admixed with one of the water-soluble thermoplastic polymers disclosed supra, along with an effervescent inorganic salt base, such as sodium bicarbonate.

Advantages

The present invention has numerous advantages. For example, it can be used to sanitize water or to deliver hydrophobic photobleaches to soiled fabrics. It is useful in nonaqueous cleaning, e.g., dry-cleaning. The invention provides improved photobleaching of dingy soils. The invention accommnodates a range of hydrophobic photobleaches, providing flexibility to the formulator. In short, the invention is a significant technical advance.

Other Embodiments

While the present photobleach compounds are especially directed to use in consumer product compositions, it is believed that they may also be useful in any other context or product other than consumer products and photodymanic therapy in which the present photoactive compounds are required. This includes, for example, the electronics industry.

EXAMPLES

Example 1

(a) Preparation of the ligand $CH_3OSi(CH_3)_2(CH_2)_3N(CH_3)(CH_2)_2N(CH_3)_2$

Under Ar, a solution of $CH_3OSi(CH_3)_2(CH_2)_3Cl$ (10.0 g, 59.3 mmol), $CH_3NHCH_2CH_2N(CH_3)_2$ (10.0 g, 98.2 mmol)

and methanol (5.0 mL) is refluxed for 22 h and then concentrated with a rotary evaporator (about 10 Torr, about 45 ° C.). The concentrate is diluted with ether (50 mL) and filtered. The solid is washed with ether (50 mL), the washings and the filtrate are combined, and the resulting solution is concentrated with a rotary evaporator (about 60 Torr, about 30 ° C.). The concentrate is filtered and the solid is washed with ether (10 mL). The washings and the filtrate are combined, and the resulting solution is concentrated with a rotary evaporator (about 60 Torr, about 30° C.). The resultant ligand, $CH_3OSi(CH_3)_2(CH_2)_3N(CH_3)(CH_2)_2N(CH_3)_2$, having the form of a light yellow liquid, is weighed (8.46 g, 36.4 mmol, 61%).

(b) Synthesis of the photobleach compound Si(IV)(PC)$L_2$ where L is —$OSi(CH_3)_2(CH_2)_3N(CH_3)(CH_2)_2N(CH_3)_2$ This photobleach compound has the formula Si(IV)(Pc)$L_2$ having two ligands, L, which occupy axial positions and have the structure:

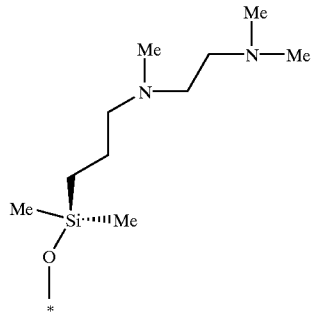

where the asterisk (*) shows the valence which is to be bonded to the Si(Pc) moiety in the photobleach compound.

A mixture composed of the ligand $CH_3OSi(CH_3)_2(CH_2)_3N(CH_3)(CH_2)_2N(CH_3)_2)_2$ (2.47 g, 10.6 mmol, Example 1) and a suspension of the photobleach precursor $Si(PC)(OH)_2$ where PC=phthalocyanine (1.50 g, 2.62 mmol, Aldrich) and pyridine (140 mL) previously dried by distillation (about 6 mL of distillate) is slowly distilled for 2.5 h (about 26 mL of distillate) and filtered. The filtrate is evaporated to dryness with a rotary evaporator (about 10 Torr, about 40° C.), and the solid is washed with an ethanol-water solution (1:2, 60 mL) and extracted with $CH_2Cl_2$ (60 mL). The extract is evaporated to dryness with a rotary evaporator (about 60 Torr, about 30° C.), and the resulting solid is washed with hexanes (100 mL), chromatographed (ethyl acetate, $Al_2O_3$ V, 3.2×18 cm, ethyl acetate-$Et_3N$, 10:1), dried (about 60 Torr, about 60° C.) and weighed (1.55 g, 1.59 mmol, 61% yield). The resulting photobleach compound, $Si(Pc)(OSi(CH_3)_2(CH_2)_3N(CH_3)(CH_2)_2N(CH_3)_2)_2$, is a microcrystalline solid. UV-Vis (dimethylformamide) $\lambda_{max}$=669, $\epsilon$=310,000.

The compound is photoactive and useful in consumer products.

Consumer Product Composition Examples

Example 2

Dry-Cleaning Additive

The compound of Example 1 at a concentration of 500 ppm is mixed with PEG 4,000. The mixture permits more convenient handling of the photobleach. The mixture is used as a dry-cleaning additive in a conventional dry-cleaning operation. Photobleaching occurs when the dry-cleaned fabrics are worn.

Example 3

Dry-Cleaning Additive

The compound of Example 1 at a concentration of 500 ppm is mixed with PEG 4,000. The mixture permits more convenient handling of the photobleach. The mixture is used as a dry-cleaning additive in a dry-cleaning operation. The dry-cleaning operation is modified by the inclusion of a light source. Photobleaching occurs in the dry-cleaning appliance.

Example 4

Pre-Treater

The compound of Example 1 at a concentration of 500 ppm is mixed with stearic acid and formed into a stick. The stick permits direct application of the photobleach to a stained fabric. The mixture is used as a dry-cleaning pretreat additive or directly by the consumer, especially immediately after staining a fabric. For example, the stick is directly applied to a curry stain on a tablecloth. In this manner, the curry stain is treated a good while before it can be sent for laundering. Photobleaching occurs when the fabric is exposed to light.

Example 5

Spray Treater

The compound of Example 1 at a concentration of 500 ppm is mixed with a fluorocarbon solvent and placed in a spray bottle or aerosol can. The spray application permits treatment of a surface having a more extended area than that of a localized stain. Photobleaching occurs when the treated surface is exposed to light.

Example 6

Laundry Detergent Compositions Having Granular Form

| | weight % | | | |
|---|---|---|---|---|
| Ingredients | 6-1 | 6-2 | 6-3 | 6-4 |
| Photobleach of Example 1 | 0.01 | 0.10 | 0.20 | 0.30 |
| Detersive surfactant Sodium $C_{11}$ Linear Alkylbenzene Sulfonate | 15 | 30 | 20 | 25 |
| Detersive surfactant $C_{24}E_5$ or $C_{45}E_{5-7}$ nonionic | 0 | 1 | 1 | 1 |
| Detersive surfactant $C_{12}$ alkyldimethylammonium chloride | 0.5 | 1 | 0.5 | 0 |
| Builder Sodium Tripolyphosphate | 15 | 35 | 22 | 0 |
| Builder Zeolite Na A (1–10 micron) | 0 | 0 | 0 | 30 |
| Builder Sodium Carbonate Anhydrous | 10 | 10 | 15 | 15 |
| Dispersant Sokalan ® CP5 (BASF) | 2 | 2 | 0 | 2 |
| Antiredeposition agent Carboxymethyl Cellulose | 0 | 0.1 | 1 | 1 |
| Brightener Tinopal ® CBS-X (CIBA) | 0.1 | 0 | 0 | 0 |
| Brightener Mixture (CIBA) | 0 | 0.1 | 0.1 | 0 |
| Soil Release Agent[1] | 0.2 | 0.2 | 0 | 0.3 |
| Enzyme Savinase ® 6.0T Novo) | 0 | 0.6 | 0.5 | 0.6 |
| Enzyme BAN ® 300T (Novo) | 0 | 0.1 | 0.5 | 0.6 |
| Enzyme Lipolase ® 100T (Novo) | 0 | 0 | 0.2 | 0.3 |
| Enzyme Carezyme ® 5T (Novo) | 0 | 0.2 | 0.2 | 0.3 |
| Bleach Sodium Perborate Monohydrate | 0 | 0 | 3.0 | 5.0 |

-continued

| Ingredients | weight % | | | |
|---|---|---|---|---|
| | 6-1 | 6-2 | 6-3 | 6-4 |
| Bleach Activator Nonanoyloxybenzene sulfonate, Na salt | 0 | 0 | 2.0 | 3.0 |
| Moisture + SodiumSulfate + Perfume – Miscellaneous | Balance to 100 | Balance to 100 | Balance to 100 | Balance to 100 |

[1]Soil Release Agent according to U.S. Pat. No. 5,415,807 Gosselink et al., issued May 16, 1995.

Example 7

Fabric Softener

The compound of Example 1 at a concentration of 500 ppm is mixed with a commercial fabric softener sold as DOWNY® by the Procter & Gamble Co. The softener is used in the normal manner. Photobleaching occurs when the treated fabrics are exposed to light.

Example 8

Formulated Photodisinfectant

The compound of Example 1 (10%) and PEG 4000 (90%) are intimately mixed. 10% by weight of the mixture is blended with sodium bicarbonate to form a simple formulated photodisinfectant.

Example 9

Tert-butyl Substituted Si(IV) Phthalocyanine Photobleach $SiPc(t\text{-}Bu)_4(OSi(CH_3)_2(CH_2)_3NH_2)_2$. A mixture composed of $C_2H_5OSi(CH_3)_2(CH_2)_3NH_2$ (1.22 g, 7.58 mmol) and a suspension of $SiPc(t\text{-}Bu)_4(OH)_2$ (1.00 g, 1.26 mmol) and pyridine (120 mL) dried by distillation (~8 mL of distillate) is slowly distilled for 2 h (~18 mL of distillate). The solution is evaporated to dryness with a rotary evaporator (5.2 Torr, 35° C.), and the semisolid formed is washed with an EtOH-water solution (50 mL, 4:1), dried (~90 Torr, ~60° C.), and weighed (1.04 g, 1.012 mmol, 81% yield). UV-vis ($\lambda_{max}$(nm); $CH_2Cl_2$) 675. NMR (300 MHz, $CDCl_3$): δ9.57 (m, 1,4-Pc H), 8.38 (m, 2/3-Pc H), 1.82 (m, $CCH_3$), 1.18 (m, $\gamma CH_2$), −1.24 (m, $\beta CH_2$), −2.31(m, $\alpha$-$CH_2$), −2.85 (s, $SiCH_3$). The compound is blue.

What is claimed is:

1. A composition comprising:

(A) a photobleach comprising:

a) a metal or metalloid selected from Ga, Ge, Sn, Si and Al;

b) a chromophore selected from substituted phthalocyanine, unsubstituted phthalocyanine, substituted naphthalocyanine and unsubstituted naphthalocyanine; and c) one or two bonded ligands, occupying axial positions;

wherein at least one of said ligands has the formula:

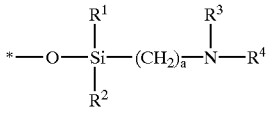

wherein $R^1$ and $R^2$ are $C_1$–$C_4$ alkyl moieties, a is a number from 2 to 16, and $R^3$ and $R^4$ are each independently selected from the group consisting of H, $C_1$–$C_{18}$ alkyl, alkaryl, a moiety having the formula:

$$—(CH_2)_b—X$$

wherein b is a number from 2 to 16, X is a heteroatom containing moiety; * marks the bond to said metal or metalloid;

B) polyethylene glycol; and

C) the balance carriers and adjunct ingredients.

2. A composition according to claim 1 wherein said chromophore is selected from the group consisting of unsubstituted phthalocyanine, phthalocyanine substituted by from 1 to 8 $C_1$–$C_8$ alkyl or alkaryl substituents, unsubstituted naphthalocyanine and naphthalocyanine substituted by from 1 to 8 $C_1$–$C_8$ alkyl or alkaryl substituents and said ligand has a formula selected from the group consisting of:

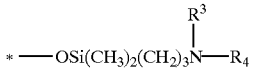

wherein $R^3$ and $R^4$ are selected from the group consisting of H and methyl and $—(CH_2)_2N(CH_3)_2$.

3. A composition according to claim 1 wherein said metal or metalloid is selected from the group consisting of Si and Al and said chromophore is selected from the group consisting of unsubstituted phthalocyanine and phthalocyanine substituted by from 1 to 8 tert-butyl substituents.

4. A composition according to claim 1 wherein said metal or metalloid is Si(IV).

5. A composition according to claim 2 wherein said chromophore is selected from the group consisting of phthalocyanine substituted by from 1 to 8, tert-butyl substituents and wherein said substituents are attached to carbon atoms of the phthalocyanine which are maximally remote from the metalloid.

6. A composition comprising at least about 0.001 ppm of a composition according to claim 1.

7. A method for cleaning a dingy fabric comprising a step of treating the dingy fabric with a consumer product composition comprising a composition according to claim 1.

8. A process for providing intermediate compositions of formulated photobleaches for use in consumer products, or for improving ease of formation thereof, said process comprising the steps of:

(a) providing a composition according to claim 1 in the absence of adjuncts; and (b) mixing said composition with one or more adjuncts, thereby forming an intimate mixture of said photobleach in said adjunct or adjuncts.

* * * * *